United States Patent [19]

Boyd et al.

[11] 4,306,621

[45] Dec. 22, 1981

[54] METHOD FOR IN SITU COAL GASIFICATION OPERATIONS

[76] Inventors: R. Michael Boyd, R.F.D. 2, Box 102, Hwy. 30; Dennis D. Fischer, 1606 Barratt St.; Alan E. Humphrey, 1717 Bill Nye Ave.; S. Bruce King, 1514 Barratt St.; David L. Whitman, 1426 Beaufort St., all of Laramie, Wyo. 82070

[21] Appl. No.: 152,716

[22] Filed: May 23, 1980

[51] Int. Cl.[3] ..... E21B 43/247; E21B 43/30; E21B 47/04

[52] U.S. Cl. ..... 166/245; 166/251; 166/259; 166/261; 166/263

[58] Field of Search ..... 166/245, 251, 256, 259, 166/261, 263, 271; 299/2; 48/DIG. 6

[56] References Cited

U.S. PATENT DOCUMENTS

| | | | |
|---|---|---|---|
| 2,973,811 | 3/1961 | Rogers | 166/251 |
| 3,004,596 | 10/1961 | Parker et al. | 166/245 |
| 3,132,692 | 5/1964 | Marx et al. | 166/245 |
| 3,152,638 | 10/1964 | Geffen et al. | 166/245 |
| 3,205,942 | 9/1965 | Sandberg | 166/245 |
| 3,386,504 | 6/1968 | Kunetka | 166/245 |
| 3,775,073 | 11/1973 | Rhoades | 166/256 X |
| 3,997,005 | 12/1976 | Komar | 166/245 X |
| 4,026,356 | 5/1977 | Shuck | 166/259 |
| 4,036,298 | 7/1977 | Kreinin et al. | 166/256 X |
| 4,083,402 | 4/1978 | Antonova et al. | 166/251 |
| 4,099,567 | 7/1978 | Terry | 166/259 X |
| 4,114,688 | 9/1978 | Terry | 166/259 X |
| 4,135,578 | 1/1979 | Terry | 166/245 |

*Primary Examiner*—Stephen J. Novosad
*Assistant Examiner*—George A. Suchfield
*Attorney, Agent, or Firm*—Roland H. Shubert

[57] ABSTRACT

An in situ coal gasification process adapted for large scale commercial projects is provided. Techniques are provided to insure establishment of a gasification front over the full seam thickness as each successive injection well in the array is brought on line. This is accomplished by controlling the oxidant introduction in a prescribed manner during the early stages of injection after pneumatic communication between well pairs has been established. Also provided are techniques and standards for avoiding or controlling subsidence and for conducting gasification operations in free water laden seams and in coal seams subject to spontaneous combustion.

32 Claims, 4 Drawing Figures

METHOD FOR IN SITU COAL GASIFICATION OPERATIONS

BACKGROUND OF THE INVENTION

This invention relates generally to the in situ gasification of coal to produce a combustible gas product.

More specifically, this invention relates to methods and techniques for conducting in situ coal gasification on a practical and commercial scale.

Attempts to develop in situ coal gasification technology have occurred around the world during the last 60 years. Large research efforts have been undertaken in the U.S., the USSR, the U.K., France, Poland, Czechoslovakia, Canada, the Federal Republic of Germany and Belgium. Only in the USSR has the technology operated at commercial scale.

Impending shortages of natural gas and petroleum liquids together with sharply increasing prices for those commodities has focussed renewed interest on all processes which hold promise for the practical conversion of coal into gaseous and liquid forms. In situ coal gasification is one of the more highly developed techniques but commercial practicability in this country has yet to be convincingly demonstrated.

Successful application of in situ coal gasification technology results in recovery of gaseous products and liquid byproducts from coal resources which cannot be recovered using conventional coal mining techniques. Either low- or intermediate- Btu gas can be obtained from the process depending upon whether air or oxygen is the injected oxidant, respectively. The process has several apparent advantages over surface-based coal gasification operations in that the coal need not be mined, no coal transportation or preparation is required, the need for surface pressure vessels for gasification is eliminated, and solid waste disposal requirements are greatly reduced since the great majority of the ash is left underground. Less apparent but important advantages over surface-based gasification processes include: Increased thermal efficiency since the in situ gasifier can be operated at higher temperatures because concerns about corrosional and erosional effects of components in the product gas are reduced; lower high quality water requirements since water of any quality present in the coal seam or adjacent aquifers can serve as the hydrogen source required for gasification thereby lowering steam injection requirements; and, less sensitivity to economics of scale since the in situ gasification production facility consists of adding process wells to increase output with the cost of each well being roughly the same whether 100 or 1,000 wells are required.

The process is basically a simple one involving the following steps: Drilling and completing wells using conventional techniques in order to access the coal seam; enhancing the natural permeability of the coal seam in order to allow injection of sufficient oxidant to achieve efficient gasification conditions; and, gasification of the coal seam between successive pairs of process wells over a large area to provide the desired quantity of product output. Experiments have been conducted in the USSR on coals ranging in rank from lignites to anthracite in seams of variable thickness with dip angles from 0° to near 90° from horizontal.

The U.S. patent literature is replete with various in situ methods for recovering energy from coal. In spite of this plethora of prior art, there is lacking an appreciation of the practical economic and technical limits imposed by in situ operations and of the need for a method amenable to large scale systematic expansion of the process.

One common thread that runs explicitly or implicitly through much of the technical literature on in situ gasification is the criticality of the linkage path location between wells; that the linkage path must be located near the bottom of the coal seam to achieve a successful operation. Experimental support for this conclusion appears to be substantially based on the highly successful test burn at Hanna, Wyo., in 1976. Downhole instrumentation showed that the reverse combustion linkage path was located about 5 feet above the bottom of the 30-foot coal seam being gasified.

Later experimental tests have shown that linkage path location at or near the bottom of the seam does not guarantee success. The first of these tests, conducted at a site near Gillette, Wyo., in 1977, resulted in formation by reverse combustion of a linkage path 8 feet off the bottom of the 25-foot thick coal seam being gasified. The results were still disappointing during the subsequent gasification phase. These lower than expected results were due to unsuitable site characteristics rather than to the location of the linkage path. The lower than expected results have been explained by the conducting organization as the result of combustion zone override to the top of the seam due to blockage of the linkage path by roof collapse.

In the second test, also conducted near Gillette, Wyo., in 1979, directional drilling was utilized to place a small-diameter pathway in the lower ½ of the same 25-foot thick coal seam. After vertical wells were drilled and connected to the drilled pathway, reverse combustion was utilized to enlarge the drilled pathway. Again, the results were not up to expectations due to unsuitable site characteristics.

Conversely, location of the linkage pathway at or near the top of the seam does not preclude successful operations. The first test conducted at a site near Hanna, Wyo., in 1973 and early 1974 was successful even though later drilling of the affected area clearly showed that linkages created by reverse combustion were located in the top few feet of the 30-foot thick coal seam being used.

The inventors herein have found that the emphasis accorded linkage path location by the prior art has been misplaced; that, in fact, location of the linkage path is of no importance in the successful conduct of large-scale in situ gasification operations.

SUMMARY OF THE INVENTION

It has been found that in a properly selected site a successful in situ coal gasification process requires the initial establishment of the gasification front over the full seam thickness as each successive well in the well array pattern becomes an injection well. A full seam gasification front is established by controlling the manner of oxidant injection to cause the gasification zone to slowly expand outward from the bottom of the injection wellbore and thereafter expand upward around the wellbore until full seam thickness is utilized. Thereafter, the gasification zone becomes stable and self-propagating over the entire seam thickness and the linkage path serves only as a conduit for product gas flow to the producing well.

Hence, it is an objective of this invention to provide an in situ coal gasification process amenable to systematic large scale expansion of the burn front over the entire seam face.

It is another object of this invention to provide a method for establishing a full seam gasification front at an injection wellbore.

Yet another object of this invention is to ptovide operating criteria for the successful operation of large-scale in situ gasification projects.

Other objects, advantages and novel features of the invention will become apparent from the following discussion and description of the invention.

DISCUSSION AND DESCRIPTION OF THE INVENTION

Figure 1:
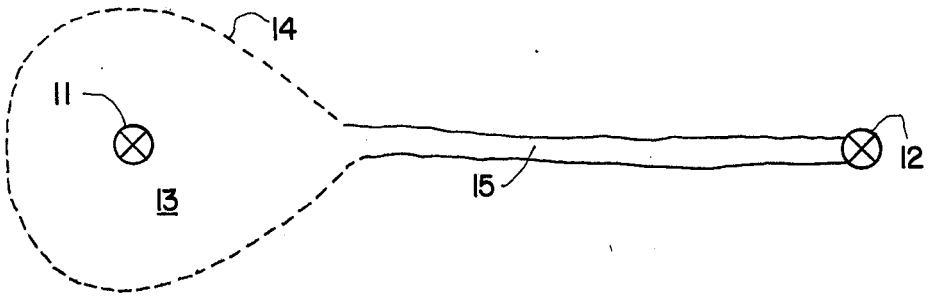
FIG. 1 in the drawing is a schematic depiction in plan view of a well pair at an intermediate stage of gasification.

The successful operation of an in situ coal gasification project requires, firstly, the selection of a proper site and, secondly, the proper establishment, control and propagation of the gasification front over the full seam thickness. More particularly, the necessary steps required for a successful operation may be generally stated as site selection, site characterization, process design and process operation.

Site Selection

Site selection consists of identifying a suitable seam or seams for the process on a property area sufficiently large for the term of planned operations. Major considerations are seam thickness and depth; coal quality; lithology of overburden and floor rock and assessment of overburden competence; general geologic characteristics such as degree of faulting, occurrence of aquifers, and continuity of lithology over the identified property; and, current land and water use patterns in the area. Without extensive field work involving drilling, geophysical surveys, and hydrologic characterization, this step is only a screening effort to eliminate areas for obvious reasons of unsuitability for the process. Examples of obvious reasons for not selecting an area are the presence of unconsolidated overburden such as sand from the coal seam to near the surface with a coincident high risk of product gas leakage to the surface or the presence of a prolific aquifer either within the coal seam or in the near overburden which, if interconnected to the gasification zone, could flood the zone leading to a serious drop in process efficiency. If the water in the aquifer is of high quality, serious environmental concerns could also prevent regulatory bodies from granting the permits required prior to operation. Thus, the process cannot be applied at any location just because sufficient coal resource has been identified.

The following general site selection criteria, based in part on current economic conditions, have been established:

1. Seam thickness and depth.

The minimum acceptable seam thickness is on the order of 6 feet. This minimum thickness results because of increased heat losses to surrounding strata from seams thinner than this figure thus lowering the gross heating value of the product gas below acceptable levels. Injection of oxygen or oxygen-enriched air can overcome the low gas heating value but economic limitations on product selling price may preclude these options. In theory, no maximum seam thickness limitation exists. Practically, a thick seam at a shallow depth may not be acceptable due to the high risk of subsidence to the surface. Therefore, the ratio of depth to seam thickness is a measure of suitability with the minimum seam thickness listed above being a further limit. The acceptable values of this ratio are a maximum of 50 for shallow seams (greater than 200 feet to less than 500 feet) to a maximum of 60 for seams at depths greater than 500 feet under current economic conditions. Seams of greater than 6 feet thickness at depths of less than 200 feet are not considered suitable due to the potential for subsidence. As the price of energy increases, the above maximum values could increase substantially and are given here only as examples.

The presence of partings in the seam must also be considered. Their occurrence does not preclude suitability of a coal seam. As an example, a coal seam might have an aggregate thickness of 10 feet with single or multiple partings accounting for 4 feet of that aggregate thickness. This could still be a suitable coal seam if it meets the depth to thickness ratio stated previously. No parting should be of a thickness greater than the thickest coal seam within the total aggregate thickness being assessed, e.g., multiple thin seams (2 to 3 feet thick) separated by numerous partings of greater than 3 feet are usually not suitable.

Previous investigators have alluded to the beneficial nature of partings for maintaining a linkage path low in the coal seam as an essential feature of in situ coal gasification. The location of partings within a coal seam has been found to be irrelevant to successful operation on a large scale.

2. Coal rank

All ranks of coal can be gasified in situ as has been demonstrated experimentally in the USSR. The primary problem which must be overcome is enhancement of the natural permeability for high free swelling index bituminous coals, as well as for semi-anthracite and anthracite varieties. This is not normally a problem for lower rank coals.

3. Lithology

The strata overlying the coal seam to be gasified must be sufficiently competent to minimize the potential for subsidence to the surface. Thus, materials such as sand or loose aggregate are unacceptable. In addition, the presence of such unconsolidated materials even at large distances of separation above the coal seam could preclude suitability of a specific site since subsurface subsidence could progress to such a height above the coal seam that these strata are intersected further increasing the degree of subsurface subsidence to the extent that subsidence might propagate to the surface. No reliable method for predicting subsidence has yet been developed in the art. Only experience in the technology can be relied upon for judgment at this time. Development of reliable subsidence prediction models would offer an important tool to the site selection process, but any model must be capable of incorporating thermal effects on the near overburden to determine how the physical strengths of these strata change as a function of temperature. In addition, no specific criteria can be established for the floor rock since no reliable technique for predicting floor heaving has been developed. Floor heaving could be important if, for example, it resulted in communication of the gasification zone with an aquifer system below the target coal seam. In general, the overburden should be sufficiently competent after exposure to high temperatures to allow the formation of semi-stable or stable arches after removal of coal to preclude surface subsidence and should consist of competent sedimentary rocks such as limestones, shales and sandstones.

4. Permeability distribution

The primary criterion is that the target coal seam should be immediately overlain and underlain by materials of significantly lower permeability than the coal such that these adjacent strata will not be the path of least resistance to oxidant flow during permeability enhancement operations. In addition, higher permeability of adjacent strata relative to the coal seam could result in excessive gas loss rates during gasification operations.

Permeability distribution within the coal seam is not critical to the process other than for permeability enhancement operations. If the permeability is extremely low, it can be overcome by high pressure oxidant injection and reverse combustion, for example, so long as such operations do not result in fracturing the overburden to such a degree as to create higher permeability in the overburden than in the coal seam. In addition, other permeability enhancement methods including, for example, hydraulic fracturing or stimulation, explosive fracturing, directional drilling, injection of components to dissolve coal to form a pathway between wells, and use of lasers to form a linkage pathway between wells, and a combination of firing projectiles from the bottom of the wellbore to form an initial small diameter pathway followed by reverse combustion to enlarge the pathway have been suggested in the art.

5. Occurrence and effects of groundwater

Since all coal gasification requires a hydrogen source, the presence of some free water in the coal seam or adjacent strata is beneficial to the process to reduce the quantity of steam which might otherwise need to be injected. Only the presence of excessive amounts of groundwater requires attention. Under optimum in situ gasification conditions, about 0.1 to 0.3 pounds of water are consumed per pound of coal gasified. Water influx rates resulting in excess water availability will adversely affect the efficiency of the process by lowering the in situ temperatures due to vaporization of the excess water. Water influx rates can only be partially controlled by the adjustment of reservoir pressure to higher values. In theory, water influx can be controlled solely by increasing reservoir pressure. Practically, since the coal seam is not a totally confined reservoir, this theoretical control cannot be achieved. If an aquifer overlying the coal seam becomes interconnected to the gasification zone due to subsurface subsidence, the available water will enter the gasification zone in an uncontrolled manner unless the reservoir pressure is raised to levels well above the hydrostatic pressure in the interconnected aquifer. If the pressure is raised to such levels, gas leakage must result adversely affecting over-all process economics.

Therefore, the presence of aquifers having the capacity to provide sufficient water to adversely affect the process must either be avoided to means to dewater such aquifers must be employed. Methods to achieve dewatering of aquifers overlying the target coal seam are generally confined to pumping excess groundwater from wells completed into the overlying aquifer using various well pattern arrays as has been described in the art.

An entirely different problem is presented, however, when the coal seam constitutes an aquifer and is itself the source of excess groundwater. In this circumstance, it has been found that such a seam can be dewatered by placing an array of wells at or near the boundary established for each production module. Linkage is established between adjacent wells as by reverse combustion techniques and a boundary cavity around the whole production module is then created by gasifying between the linked wells. After the gasified area has cooled by influxing ground-water from the coal seam, pumping is initiated and is continued until the production module has been dewatered sufficiently to allow efficient gasification of the coal within the area outlined by the boundary cavity. Under any circumstances, aquifers containing water of high quality must be separated by sufficient distance from the target coal seam to preclude their becoming interconnected to the gasification zone in order to avoid unacceptable environmental costs.

The coal seam need not be an aquifer for successful in situ gasification operations. This conflicts with previous investigators who have indicated that in situ coal gasification operations should be conducted in seams containing free water such that the available groundwater acts as a gas seal. This criterion can only apply for small-scale operations since roof falls are in integral part of any large-scale in situ operations resulting in pathways for gas flow to strata overlying the coal seam thus precluding an effective seal either by water in the coal seam or water in an overlying aquifer as previously discussed above. A dry coal seam can be utilized by adjusting the reservoir pressure to low values to minimize gas losses while still maintaining process control. Steam or carbon dioxide are then injected with either air or oxygen to maximize the production of hydrogen and/or carbon monoxide at acceptable concentrations according to the following reactions:

$$C + H_2O + Heat = H_2 + CO \quad (1)$$

$$C + CO_2 + Heat = 2\ CO \quad (2)$$

Reaction (2) will only proceed to any significant degree after reactions (1) has utilized the available water vapor since both kinetics and thermodynamics favor reaction (1). Thus, injection of both $CO_2$ and water vapor simultaneously with air or oxygen is of little, if any, benefit. In addition, injection of $CO_2$ into a wet coal seam will also be of little benefit. But, injection of $CO_2$ along with air or oxygen into a dry or near-dry coal seam (dry referring to the absence of any free water) is beneficial to increase the concentration of CO in the product gas and offers a means for recycling a portion of the $CO_2$ removed from the product gas during surface processing.

6. Presence of faulting and coal seam discontinuities

The presence of large-scale (greater than seam thickness) faulting or seam discontinuities within the target area is of importance due to the detrimental effects they can have on process control and efficiency. If the locations of major faults, sand channels, or pinchouts are known, design considerations can be given to minimize process upsets which can result due to these features. If their locations are unknown, these features may provide unexpected paths for abnormal influx of groundwater, leakage of product gas, and potential process interruptions. Small-scale faulting (less than seam thickness displacement) cannot, in most cases, be detected or avoided, and, for large-scale operations, is of minor significance since only a small percentage of the production will be affected.

7. Presence of other mineral recovery activities in the area

The presence of active or abandoned oil and gas recovery wells or mining activities at a location being considered for in situ coal gasification may preclude use of significant portions of the area. This is due to the increased potential for leakage up along active or abandoned oil and gas wellbores where the cement bond may no longer be competent or due to gas leakage to mine workings. In addition, the casing in oil and gas wells may be damaged due to thermal stress or subsurface subsidence caused by the process resulting in rupturing of the casings. Although their presence can be overcome, the in situ operation must be designed to work around these features if they are present or must be conducted at distances sufficient from them to minimize the problems which could result.

Other factors may require consideration depending upon the site, but these are the minimum criteria which must be assessed prior to selecting an area for in situ coal gasification operations.

SITE CHARACTERIZATION

Based on the site selection criteria described in the preceding section, it is evident that significant amounts of characterization work must be performed before a final site choice can be made. This work can be arranged in any logical sequence but must, at a minimum, consist of the following:

1. Evaluation wells

Drilling and downhole logging of a sufficient number of evaluation wells to determine coal seam continuity and to obtain cores of overburden, coal, and floor rock for analyses and physical properties determination are necessary. The great majority of these wells can later be used as process wells.

2. Coal analyses

Analyses of numerous coal samples obtained from the evaluation wells is necessary to determine variations in coal quality over the area to be gasified. These analyses should, as a minimum, include ultimate and proximate analyses; determination of as-received heating value; determination of sulfur forms (pyritic, organic, and sulfate sulfur); elemental composition of the ash; and, Fischer assays at 900° C. to determine the total amount of volatile gases and concentration of individual gases (CO, $H_2O$ vapor, $CO_2$, $CH_4$, $C_2$–$C_4$'s, $H_2$) in the volatile gases per pound of coal as well as the total amount of light oils and tars volatilized per pound of coal. These data, used with appropriate mathematical models, allow prediction of product gas compositions during commercial operations.

3. Lithologic characterization

Analyses of overburden and floor rock samples obtained from recovered cores for tensile and compressive strength, bulking properties as a function of temperature, and permeability allow assessment of the subsidence potential for a specific site and indicate where potential gas loss zones are located relative to the coal seam.

4. Hydrologic characterization

Hydrologic characterization and analyses of the groundwater within each aquifer located above, within, or within a reasonable distance below the target coal seam may be conducted using some of the evaluation wells. The hydrologic characteristics, such as location of the piezometric surface, hydrostatic pressure, transmissivity, storage coefficient, hydraulic gradient, and recharge rate, should be determined for each aquifer. In addition, such things as mobility, hydraulic conductivity, and isotropy or anisotropy may be determined. These characteristics can be used to determine the direction of and rate of groundwater movement for each aquifer. The productivity of each aquifer must be determined by pumping tests. Monitoring of aquifers during the necessary data gathering steps allows for determination of the degree of interconnection between aquifers identified. The presence of faults can be inferred from analyses of the hydrologic data and the need for dewatering operations can be determined.

Required analyses of water samples from each aquifer are set by State or Federal law and need not be described here. Methods for ensuring the gathering of representative samples and for sampling multiple aquifers from the same wellbore are well known and need not be described here.

5. Geophysical data

Geophysical surveys aid in determining the presence and extent of faulting and other coal seam discontinuities. The effectiveness of techniques used to make these determinations will be dependent upon the depth and seam thickness. These techniques are well known and have been in use in the minerals industry for extended periods of time. Data gathered here in conjunction with the results of drilling and logging better indicate how the coal seam must be blocked out to avoid the detrimental effects of identified areas of faulting and other coal seam discontinuities.

6. Acceptance testing

Air acceptance testing serves to determine whether reverse combustion linking can be used to enhance seam permeability or whether other permeability enhancement methods are more suitable. Testing may utilize several evaluation wells completed into the coal seam. Testing is conducted by injecting air at a central well at a maximum pressure of about 1 psig per foot of depth to the bottom of the coal seam and measuring production rates at surrounding wells. These data will be used to determine the allowed spacing between wells for reverse combustion linking.

Many previous investigators have indicated that this step is not required, but is has been found to be far more reliable than analyses of oriented cores for determining predominant flow directions. However, its usefulness for large areas requires conducting testing at several locations. Considering the large investment inherent to commercial operations, its reliability overshadows the cost. The conduct of such air acceptance testing is less expensive than taking oriented cores over a large area followed by laboratory analyses to determine directional permeability and provides better data for use in orienting the well pattern within production modules to take advantage of the predominant flow direction as determined under field conditions. The results of this acceptance testing will determine the orientation of the well pattern in the production modules to take advantage of the predominant flow direction determined in the field, which may vary from place to place within the total area to be used during the lifetime of the plant.

If major features detected during site characterization show high permeability, the need for permeability enhancement may be obviated in certain areas. The well pattern may be situated along these features in such a manner as to use them advantageously thereby allowing gasification without linking the wells along these features.

PROCESS DESIGN

Assuming the site characterization results have not precluded further consideration of the location, process design can then proceed. The major factors to be determined are the method of permeability enhancement, well pattern layout and spacing, operating pressure, injection rate, production rate, product gas composition, composition of injection stream, targeted coal recovery efficiency, blocking out of the area from which the coal will be extracted, the number of modules needed, the number of modules to be prepared in advance, and the total area required for the life of the operation. These factors are determined in the following manner:

1. Method of permeability enhancement

As has been described previously, numerous permeability enhancement techniques have been proposed for use with in situ coal gasification. Only three have been proven during field operations. This proof has been described in the Soviet literature. The three methods are reverse combustion linking, directional drilling, and hydraulic stimulation (U.S. Pat. No. 3,990,514). For the purpose of this invention, directional drilling is defined as any technique where drilling is initiated from the surface and conducted in such a manner as to result in a drilled pathway, the last several hundred feet of which is generally parallel to the upper and lower boundaries of the coal seam to be gasified. This drilled pathway then serves as the conduit for gas flow between wellbores. Directional drilling is not meant to include slant drilling which is commonly employed in the oil and gas industry and has been developed to a high degree of sophistication.

The first two of these three methods have been applied during testing in U.S. The method of hydraulic stimulation described in U.S. Pat. No. 3,990,514 may only be applicable to a limited range of geologic conditions. Directional drilling has been developed to a high degree of reliability in the USSR specifically for application to in situ coal gasification but is in its infancy in the U.S. and is expensive for each foot of usable hole within the target coal seam. In addition, it does not offer any significant advantage over reverse combustion linking.

Reverse combustion linking does not always result in the linking of all wells within the process well pattern since the fluid flow through the coal seam is controlled by the natural fracture distribution. The Soviets have reported that greater than 20% of the wells within a production module were not successfully linked, but the large-scale operation of in situ coal gasification was still successfully completed. This success was due to the large-scale operation where the failure of a significant portion of the linkages was minimized by the presence of a large number of active gasification channels and flow of the gases to the available linkage paths. As the gasification zone proceeded along a broad front, the wells which were not linked were eventually connected to the gasification zone and were then used as injection wells as the gasification zone was relayed through the well pattern.

The primary advantage of reverse combustion is its low cost. It is thus the preferred method of permeability enhancement, but this invention is not limited by the method of permeability enhancement. This method has been successfully used on small-scale field tests in the U.S. over distances up to 100 feet in subbituminous coal. It is projected that it could be successfully employed over greater distances (up to 250 feet). Linkages over larger (greater than 250 feet) distances may be achieved. The reason these greater distances may not be practical is the increasingly greater risk of not being able to complete a high percentage of these links and the lower resource recovery which may result. The primary consideration is that sufficient air or oxygen percolate from the point of injection to the well to be linked to sustain combustion. Recovery rates as low as 5% of injected air at the well to be linked have been successfully employed during small field tests in the U.S.

The air acceptance testing outlined during the previous description of site characterization tasks provides the data necessary to determine the well spacing which can effectively be utilized for any given coal seam. In general, the most effective range of spacings for this linking technique is on the order of 75 to 125 feet. Spacings in this range ensure a high percentage of linkage completion such that the process can be conducted in an efficient manner.

2. Well pattern layout and spacing

The conduct of large-scale operations of the technology requires a well pattern layout that offers ease of relaying the process over a large area. Thus, a square or rectangular pattern of wells within any given module is ordinarily better than either a random layout or a pattern based on the traditional 5-spot utilized in the oil and gas industry. As outlined in 1. above, the spacing of the wells parallel to the direction of gasification front movement can be determined by air acceptance testing. The spacing perpendicular to this direction of movement must be determined by the desired coal recovery efficiency balanced against the potential for subsidence at any given site. If a high percentage of coal recovery is feasible, the spacing perpendicular to the direction of gasification front movement is about $\frac{2}{3}$ of the spacing parallel to the direction of gasification front movement. This results in overlap of the gasification zones propagating from the injection wells to the production wells in any given line of wells. Field testing in the U.S. has confirmed thsi formula for single well pair operations. Approximately 80% of the coal can be recovered in this manner.

If site conditions are such that subsidence might occur leading to significant process upsets, then the spacing perpendicular to the direction of gasification front movement is increased to at least the same spacing as that parallel to the direction of gasification front movement. If the pattern is laid out in a square arrangement, approximately 60% of the coal is recovered. The remaining 40% offers roof support to delay and minimize subsurface subsidence thereby reducing the potential for process upset.

If the spacing perpendicular to the direction of gasification front movement is increased to values greater than that parallel to the direction of gasification front movement, correspondingly lower percentages of in place resource are recovered but a correspondingly greater resistance to subsidence is obtained. The ratio of well spacing perpendicular to the direction of gasification front movement to the spacing parallel to the direction of gasification front movement should not exceed 2:1. Spacings at values greater than 2:1 may not be economic. As may be appreciated, each site will ordinarily have different requirements and appropriate spacings may vary from module to module within the same site because of the changing conditions over the area to be gasified.

These variable spacings from module to module can be determined during site characterization or during operation. Modules may vary in size also due to the presence of faulting or seam discontinuities detected during site characterization thus establishing boundaries for individual modules, i.e., gasification would not be conducted across these established boundaries but only up to or parallel to them. Thus, for example, numerous modules ranging in size from 200 feet wide by 500 feet long to as much as 1000 feet wide by 2000 feet long may be blocked out prior to well pattern installation. The modules blocked out may have spacings ranging from 75 feet to 125 feet between wells arrayed parallel to the direction of gasification front movement and ranging from 50 feet to 250 feet between wells arrayed perpendicular to the direction of gasification front movement. Ordinarily though, the spacings within each module will be the same throughout that individual module.

3. Operating pressure

If reverse combustion is the chosen method of permeability enhancement, the injection pressure used during reverse combustion operations will be about 1 psig per foot of depth to the bottom of the target coal seam. The controlling factor will be the amount of recovery of injected oxidant at the well or wells to be linked. If recovery is too low at this pressure, the pressure can be increased to a level where the recovery is sufficient but should not exceed a pressure of 1.4 to 1.5 psig per foot of depth to the bottom of the target coal seam due to the potential for creating high permeability zones in the overburden which might be detrimental to future gasification operations.

During gasification, the operating pressure should be approximately equal to or less than the hydrostatic pressure within the coal seam if it is an aquifer. This allows water to influx into the gasification zone providing the necessary hydrogen source for efficient operations and provides containment of contaminants formed during pyrolysis and gasification such that their dispersement through the groundwater regime of the coal seam is minimized. Lower pressures than hydrostatic may be required if gas loss rates become excessive due to interconnection of adjacent strata to the coal seam as a result of subsurface subsidence. For dry seams, the operating pressure will be established by gas loss rates and will be a function of coal seam depth and permeability of adjacent strata as a function of pressure. In general, the operating pressure for dry seams should be held at the lowest allowable level sufficient to allow injection of the required amount of oxidant necessary for efficient gasification rates.

4. Injection rates

The injection rates required during permeability enhancement will be set by the percentage recovery at the well to be linked necessary to sustain combustion in the case of reverse combustion. An upper limit will be set by the desire to avoid too high an oxygen flux rate, i.e., exceeding the critical flux for reverse combustion, at the combustion focus such that reverse combustion is precluded. A lower rate also exists such that sufficient heat of combustion is available to permit the propagation of reverse combustion to form the linkage pathway. These upper and lower limits may be established through laboratory experimentation prior to initiation of field operations using coal samples obtained during site characterization.

During gasification, the maximum injection rate is determined by well spacing, seam thickness, and coal analyses. This maximum value can be calculated. As an example, for a 30-foot thick subbituminous coal seam containing 33% fixed carbon and at a well spacing of 75 feet, the maximum air injection rate per injection well should be about 5000 scfm. For the same seam thickness and well spacing but with 44% fixed carbon, the maximum injection rate should be about 6700 scfm to maintain the same efficiency of gasification.

Due to limited experience in large-scale operations, laboratory testing using coal samples gathered during site characterization should be conducted to determine the effect of various oxygen flux rates. This testing, conducted in a sealed chamber, should include injection of oxidants of differing compositions at pressures up to lithostatic to determine the optimum flux. The optimum value can then be compared to the calculated value and adjustments to the calculated value made if necessary.

5. Production rates

The production rate is a function of oxidant injection rate, gas loss rate and water influx rate. Laboratory tests outlined previously provide data amenable to mathematical process modeling for the calculation of production rates and total production per well after selection of well spacing for a specific target coal seam.

6. Composition of injection stream

Using the coal seam analyses obtained during site characterization, the availability of groundwater for influx to the coal seam, and the Fischer assay data, the proper mix for the injection stream can be determined. The available mixtures for consideration are air, air-steam, air-$CO_2$, oxygen-enriched air, oxygen-steam, oxygen, oxygen-$CO_2$, air-inert gas, and oxygen-inert gas. The choice of one of these over the others will depend upon the particular coal seam and the desired product.

The optimum choice can be estimated through use of mathematical process modeling using the above mentioned data as inputs to the model. As a check of the model, laboratory simulation can be conducted on coal samples using the mixtures identified to better determine their effectiveness and a final choice can be made based on weighing improvements in gas heating value versus any increased costs necessary for each individual injection stream composition.

7. Product gas composition

The product gas composition is, of course, highly dependent upon the particular injection stream used and the characteristics of the coal seam. Process modeling can be used with a high degree of reliability for predicting product gas composition especially if modeling is conducted conjointly with laboratory simulation.

8. Targeted coal recovery efficiency

Complete gasification of a coal seam within the project boundaries is not generally feasible and is often undesirable because of subsidence considerations discussed more fully in section 2 above. Coal utilization generally ranges from about 50% to 80% at a suitable site with properly applied techniques.

9. Blocking out the resource to be extracted

Seam discontinuities and the like serve to establish boundaries for process modules or for areas where operations cannot be successfully conducted. The number of process modules needed at any given time is established by the plant size, the number of wells within each process module, the well spacing within each process module, the coal seam thickness and quality, and the lifetime of each module. The number required can thus be calculated. The number of modules to be prepared ahead of time such that new process modules can be brought into production as needed can also be calculated such that process interruptions are eliminated.

After completion of these tasks, all of the information needed to perform the final engineering design is available to enable construction of the plant.

PROCESS OPERATIONS

Operation of the process itself will be described in relation to well pairs and to the propagation of a gasification front through a single process module. After the predetermined well array within a module has been accomplished with the wells drilled and completed into the coal seam, pneumatic communication between well pairs must be established. Thereafter, a full-seam gasification front is established and is systematically advanced through the module.

Referring now to FIG. 1, there is shown in plan view a well pair, one injection well 11 and one production well 12, at an intermediate stage of gasification. Oxidant is injected at well 11 to produce a gasified or depleted area 13 defined by gasification front or zone boundary 14 expanding generally radially to injection well 11. Linkage path 15 is established prior to beginning gasification and serves to conduct product gases from the gasification area to the producing well.

Figure 2:
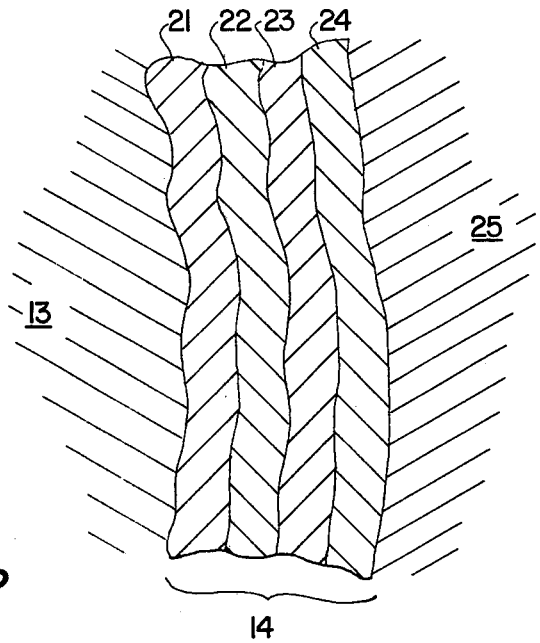
FIG. 2 is a detailed view of a segment of the gasification front.

Turning now to FIG. 2, there is shown a detailed view of a portion of gasification front 14. Because of the low thermal conductivity of coal, the total thickness of the gasification reaction front is ordinarily only a few feet. Combustion zone 21 is adjacent to previously gasified or depleted area 13. The primary reaction occurring in this zone is the combination of oxygen with carbon to produce carbon dioxide and heat. Preceeding in order, there follows gasification zone 22, pyrolysis zone 23, drying zone 24 and unmodified coal 25.

Two primary reactions occur in the gasification zone. They are:

$$C + H_2O + Heat = CO + H_2 \quad (1)$$

$$C + CO_2 + Heat = 2CO \quad (2)$$

Field data gathered to date show that reaction (2) is of minor significance if the gasification zone contains even small amounts of free water. Coal volatiles are driven off by heat in the pyrolysis zone leaving a char residue while a lower level of heat violatilizes water in the drying zone leaving dry coal.

Temperature within combustion zone 21 is estimated to range from 1800° to 2700° F. depending on oxygen flux rate, injection stream composition, and volume of influxing groundwater. Heat produced within this zone provides the energy necessary to drive the endothermic reactions occurring in the other three zones. Conduction of heat into the coal face weakens the coal structure and greatly increases its permeability due to removal of volatiles and water. As many Western coals contain as much as 35% volatile matter and 30% water depending upon coal rank, the extent of permeability enhancement can be readily appreciated. Thus, the face is continually prepared for the advance of the gasification front over a thin shell at the boundary of the gasification area. The rate of movement is greatest at the edges of the gasification front nearest the linkage path, lower at the sides and lowest behind the injection well because of fluid flow distribution imposed by the pressure differential along the line of least resistance from the injection well to the inlet to the linkage path.

Because of the thermal effects described and the flow distribution within the previously gasified area, the influence of the linkage path location is minimal. Only if the gasification front is not initially established over full seam thickness will the process suffer. Previous researchers have interpreted failures as being due to linkage path location when in fact this cannot be an explanation. The pressure drop through the linkage path is too small (less than 5 psig in small-scale field tests) for it to be a significant factor affecting fluid flow distribution to the extent necessary to yield the results obtained.

Establishment of the gasification front over the full seam thickness at an injection well requires careful control of the manner of oxidant introduction. As has been discussed previously, calculation of a maximum injection rate is a necessary step in the design of a gasification project. It varies as a function of seam thickness, well spacing, fixed carbon content of the coal, and oxygen content of the injection stream. The calculated maximum injection rate is defined as follows:

$$\text{Calculated Maximum Injection Rate (in scfm)} = kSW(FC)C$$

where

- k = A constant varying as a function of coal rank For Wyoming subbituminous coal, a value of about 8.4 ft/min has been determined
- S = Seam thickness in feet
- W = Well spacing in the direction of gasification front propagation in feet
- FC = Fixed carbon content of the coal expressed as the decimal less than one
- C = The ratio of $O_2$ concentration in air to the $O_2$ concentration in the injection stream chosen This calculation only serves as a guide to operations. The intent is to operate the process at relatively constant oxygen flux.

Control of oxidant gas introduction is accomplished by limiting the injection rate to a minor fraction of the calculated maximum injection rate for a period of time sufficient to allow the gasification zone to slowly expand outward from the bottom of the injection wellbore and then expand downward (at a much slower rate) to the bottom of the coal seam and upward around the wellbore until full seam thickness is utilized. Thereafter, the injection rate is slowly and progressively increased, until the maximum injection rate has been attained. As a general rule, the initial injection rate should not exceed $\frac{1}{3}$ of the calculated maximum injection rate during approximately the first 15% of the calculated well pair life. (The calculated well pair life is equal to the well spacing in feet divided by the average rate of gasification front movement in feet/day. The average rate of front movement observed during small-scale field tests in the U.S. has been about 1.5 feet/day. This value serves only as a guide and can vary depending upon conditions.) The injection rate is then increased to the calculated maximum injected rate over the next 15% to 30% and preferably over a period not greater than 25% of the calculated well pair life and maintained at or near this level for the remainder of the calculated well pair life.

Control of oxidant gas utilization is aided and establishment of the gasification zone over the full seam thickness is more completely ensured by use of proper well completion techniques. It is highly desirable that the well completion technique selected produce a reliable and competent bonding between the well casing and the coal seam such that oxidant flow up the outside of the casing is minimized and chimneying up around the casing does not result. It is also preferred that the wellbore be cased at least $\frac{2}{3}$ of the way through the coal seam or within about 5 feet of the bottom of the seam, whichever is closer to the bottom of the seam.

Upon initial establishment of the gasification front over the full seam thickness, it thereafter becomes stable and self-propagating over the entire seam due to thermal effects at the gasification front. After full seam thickness gasification is established, the linkage path serves only as a conduit for product flow to the production well.

The procedure described above is in effect a startup procedure to ensure establishment of a stable gasification zone over full seam thickness. It may not have to be repeated in this exact manner after startup depending upon how the well pattern within any process module has been laid out, and upon the step-by-step operating procedure which has been chosen. The need to adjust the procedure used is highlighted in the following examples:

EXAMPLE 1

Figure 3:
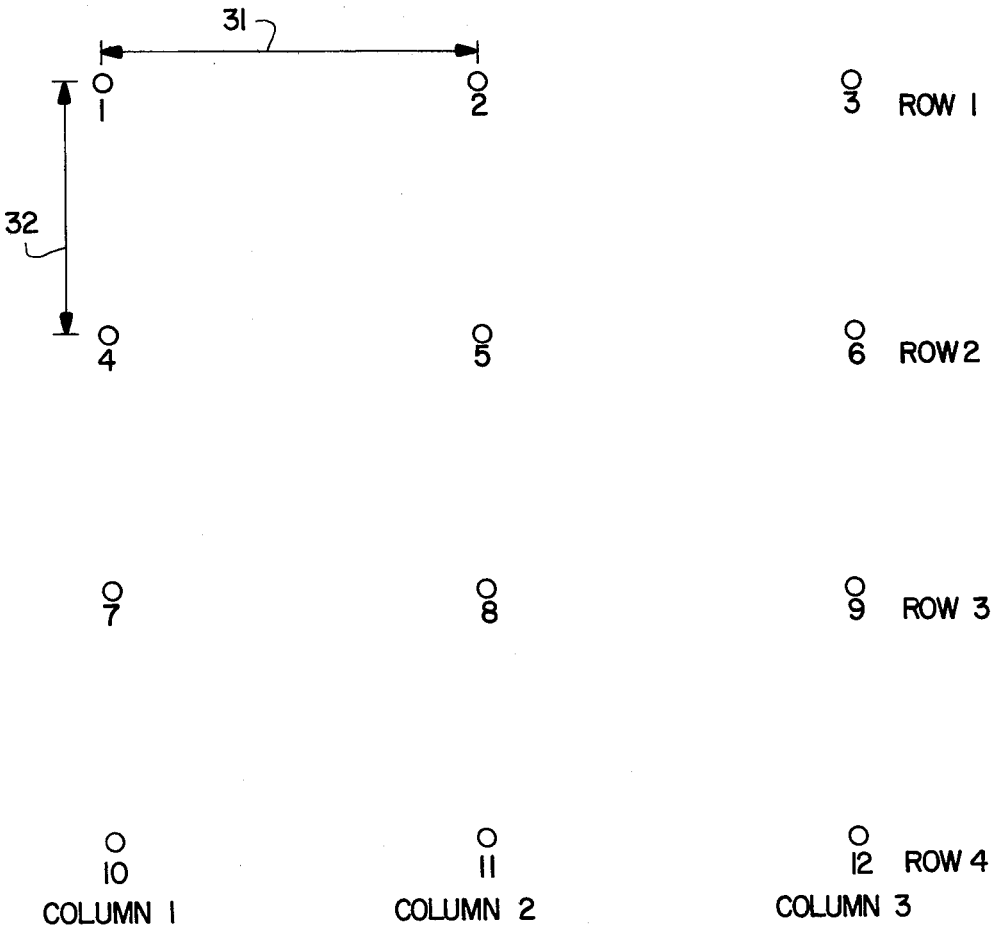
FIG. 3 is a schematic diagram of a portion of a process module.

Referring to FIG. 3, there is illustrated a schematic diagram of a portion of a process module showing wells laid out in columns and rows in a rectangular pattern. Each well is completed into the coal seam as previously described. In this example, it is desired to obtain maximum utilization of the coal resource and to achieve interconnection of the gasification channels. Hence, the spacing 31 between adjacent columns is set to be somewhat less than the spacing 32 between adjacent rows. The procedure is carried out as follows:

(a) The coal seam is ignited at well 2. Ignition is accomplished in conventional fashion using a downhole burner, placement of a pyrophoric material at the bottom of the wellbore or other suitable technique. Air is then injected into well 2 at a pressure of about 1 psig per foot of depth to the bottom of the coal seam to sustain combustion. Gas samples collected from wells 1 and 3 may be monitored to determine when ignition has been achieved. Thereafter, high pressure air, or other suitable oxidant, is injected at wells 1 and 3 until reverse combustion linkage to those two injection wells has been achieved as evidenced by a substantial, greater than 50%, reduction in injection pressure at those wells. Well 2 is used as the production well.

(b) Upon completion of reverse combustion linkage, air injection at wells 1 and 3 is limited to a rate less than $\frac{1}{3}$ of the calculated maximum injection rate for up to about 15% of the calculated well pair life to initiate gasification from wells 1 and 3 toward well 2. The injection pressure is such that the pressure within the coal seam is at or below the hydrostatic pressure within the coal seam if the coal seam is an aquifer. The air injection rate is then increased to the calculated maximum over a period preferably not greater than 25% of the calculated well pair life.

(c) High pressure air injection is initiated at wells 4, 5 and 6 to begin reverse combustion linking from Row 1 to Row 2. This step should not be initiated until the product gas temperature at Well 2 has reached a temperature of at least 300° F. indicating that the permeability pathway between wells 1 and 2 and 2 and 3 has been heated to a temperature above the ignition point of the coal all along the pathway.

(d) Upon completion of reverse combustion linking from Row 1 to Row 2 as indicated by a reduction of at least 50% in the injection pressure at all Row 2 wells, injection is initiated at each of the Row 2 wells at a rate less than or equal to $\frac{1}{3}$ of the calculated maximum injection rate at a pressure equal to or slightly less than the seam hydrostatic pressure to begin gasification from Row 2 and Row 1. All wells in Row 1 are converted to production wells after terminating injection at wells 1 and 3 prior to beginning high-volume injection at the Row 2 wells. After a time not greater than 15% of the calculated well pair life, the injection rate is increased at each well in Row 2 to the calculated maximum injection rate over a period not longer than 25% of the calculated well pair life and maintained at this rate at a relatively constant level.

(e) After the low pressure injection rate at all wells in Row 2 has been increased to greater than $\frac{1}{3}$ of the calculated maximum injection rate, high pressure injection is initiated at all wells in Row 3 to initiate reverse combustion linking from Row 2 to Row 3. Because the rate of movement of the reverse combustion front proceeds at a rate about 4 times faster than the gasification front (about 6 ft/day compared to about 1.5 ft/day), it may not be desirable to initiate this step until after a time of at least 40% of the calculated well pair life for gasification from Row 2 to Row 1 has passed in order to synchronize the relaying of the gasification process from the area between Rows 2 and 1 to the area between Rows 3 and 2 to avoid any need to reignite the coal at the bottom of the Row 3 wells. As an alternative, after completion of reverse combustion linking from Row 2 to Row 3, it may be desirable to maintain low levels of injection at all Row 3 wells to maintain the combustion zone at the bottom of these wellbores until gasification from Row 2 to Row 1 has been completed.

(f) Upon completion of gasification from Row 2 to Row 1 and completion of reverse combustion linking from Row 2 to Row 3, low pressure injection is initiated at all wells in Row 3 at a rate not greater than $\frac{1}{3}$ of the calculated maximum injection rate. All wells in Row 2 are opened to production and all wells in Row 1 are shut in. The injection rate at all Row 3 wells is maintained at a value less than or equal to $\frac{1}{3}$ of the calculated maximum injection rate for a period not greater than 15% of the calculated well pair life.

(g) The process then becomes a repetition of steps (e) and (f) as the area of the process module is gasified.

EXAMPLE 2

A variation of the procedure set out in Example 1 is as follows. Steps (a), (b), and (c) are identical to Example 1. Thereafter, the following steps are performed in sequence:

(d) Upon completion of reverse combustion linking from Row 1 to Row 2, all wells in Row 2 are converted to production wells and high-volume, low-pressure air injection is begun at all wells in Row 1 to initiate gasification from Row 1 to Row 2. The rate of injection at each well in Row 1 may be greater than 75% of the calculated maximum injection rate because the gasification front has already been established over full seam thickness during step (b).

(e) After the temperature of the product gas at all wells in Row 2 has reached a temperature greater than 300° F., high pressure injection at all wells in Row 3 is initiated to begin reverse combustion linking from Row 2 to Row 3. Upon completion of reverse combustion linking from Row 2 to Row 3, high pressure injection is terminated at all wells in Row 3 and all wells in Row 3 are then converted to production wells. Low levels (less than about 5% of individual well production capacity) of product gas are bled from the Row 3 wells to maintain open permeability pathways from Row 2 to Row 3 and to further prepare the pathways for subsequent gasification operations. The flow of hot production gases down these pathways results in further devolatilization thereby increasing the effective diameter of the pathways.

(f) Upon completion of gasification from Row 1 to Row 2, all wells in Row 3 are then opened for full production, all Row 2 wells are converted to injection wells, injection is terminated at all Row 1 wells, and injection is initiated at all Row 2 wells while all Row 1 wells are shut in. Because the gasification zone has already been established over full seam thickness between Rows 1 and 2, the injection rate at each of the Row 2 wells may not need to be reduced to $\frac{1}{3}$ or less of the calculated maximum injection rate. It usually is not necessary to reduce the injection rate to less than 50% of the calculated maximum injection rate. If any reduction is required upon initiation of injection at each of the Row 2 wells, the injection rate should be increased to the calculated maximum injection rate over a period not to exceed about 15% of the calculated well pair life.

(g) Steps (e) and (f) are then repeated until the coal in the process module has been gasified.

The procedure set out in this Example is less preferred than that of Example 1 as it has the disadvantage of exposing the process wells to hot production gases before they are converted to injection wells. This exposure could result in damage to the cement bond between the well casing and the overburden leading to the potential for increased gas losses up the outside of the casing to the overburden or to the surface.

EXAMPLE 3

In those cases where a high potential for subsidence is determined during site characterization and where it is desired to avoid the effects of subsidence to the greatest extent possible, gasification may be carried out in a series of isolated gasification channels. To accomplish this, spacing 31 between adjacent well columns of FIG. 3 is increased to a value up to but not greater than twice that between adjacent well rows, or spacing 32. Essentially isolated gasification channels are formed along each column of wells, as along the column defined by wells 1, 4, 7 and 10, leaving an ungasified residual seam portion between the columns to provide support for the overburden.

Because of the isolation between adjacent well columns, step (a) of the procedures set out in Examples 1 and 2 is modified as follows. The coal is ignited in all of the Row 1 wells and high pressure air is injected at all wells in Row 2 to initiate reverse combustion linking from Row 1 to Row 2. Thereafter, the procedure may be that set out in either Example 1 or Example 2, starting with step (d).

EXAMPLE 4

Some coal seams otherwise amenable to in situ gasification are themselves aquifers or lie in near proximity to aquifers, both conditions which may act to provide such an excess of groundwater as to preclude successful gasification. Dewatering of such seams must be carried out prior to gasification in order to achieve a reasonable degree of gasification efficiency.

Figure 4:
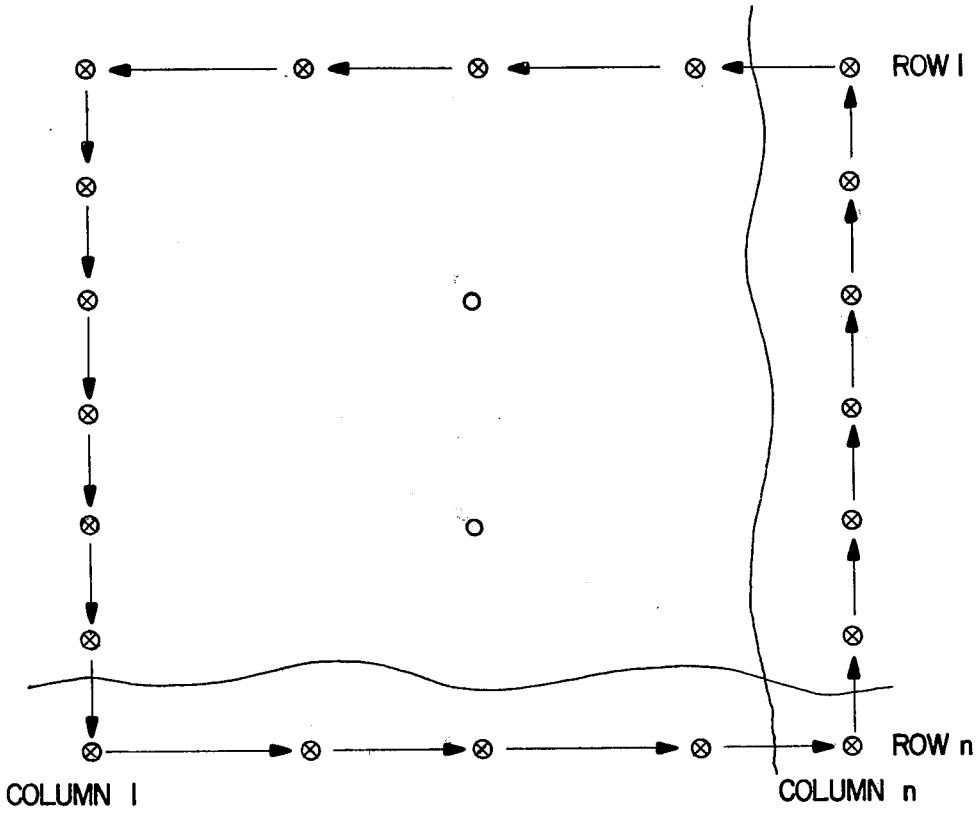
FIG. 4 illustrates a method for dewatering a coal seam prior to gasification.

As is illustrated in FIG. 4 dewatering may be accomplished by creating a boundary cavity around a process module. Referring now to FIG. 4, there is illustrated a process module having a plurality of wells arranged in a generally rectangular grid pattern of n rows and n columns. The periphery or boundary of the process module is defined by the well arrays making up Column 1, Row n, Column n, and Row 1 as is shown by the arrow path. It is usually advantageous but not essential to decrease the well spacing in the boundary columns and rows compared to the remainder of the process module as is shown in the Figure.

Isolated gasification channels or cavities are produced around the process module by igniting the coal in a selected boundary well and thereafter injecting high pressure air into an adjacent boundary well until reverse combustion linkage has been achieved. The adjacent boundary well is then converted to an injection well in the manner described in Example 1, step (d) with a progressive increase in injection rate as set forth therein. High pressure air injection in the next adjacent, or third, well is commenced to establish reverse combustion linkage between the second and third wells. The third well in turn is converted to an injection well and this procedure is repeated with succeeding wells until an isolated gasification channel is formed around the module periphery.

Injection of air into a well for some period of time before it is ignited may be necessary in order to remove free water at the bottom of the borehold. In addition, a system for liquid removal from the wells may be required in order to ensure that influxing groundwater does not quench the ignition attempts and to remove condensed liquids which will collect during reverse combustion linking operations.

Influxing groundwater will quickly cool the gasified boundary cavity. Pumping from the cavity is then initiated and is continued until the module area has been sufficiently dewatered, as evidenced by monitoring wells within the module, to allow efficient gasification of the coal seam.

All of the preceding examples have illustrated gasification methods which use reverse combustion as a permeability enhancement, or well linking, technique and which use air as the oxidant. Use of other well linking techniques, while not preferred because of technical and economic considerations, require merely the substitution of another linking technique, such as directional drilling, for the reverse combustion linkage in the outlined methods.

Substitution of oxygen-enriched air, oxygen, air-carbon dioxide, air-stream and similar mixtures may be made as desired without affecting the procedures outlined in the examples.

In addition, it is to be noted that the previously gasified area can serve as a source of hydrogen-rich gas as influxing groundwater contacts hot, residual carbon according to the following reactions:

$$C+H_2O=CO+H_2$$

$$CO+H_2O=CO_2+H_2$$

Thus, low volumes of this hydrogen-rich gas can be produced by opening the previously shut in wells in the previously gasified area for either blending with the product gas from the area undergoing gasification or for uses which require a hydrogen-rich gas.

Some lignites and subbituminous coals, usually in deep seams, spontaneously ignite when contacted with air. In these situations, the reverse combustion linkage procedure must be modified in order to achieve linkage and maximum control of the process. This is accomplished by reducing the oxygen content of air by dilution with any suitable gas including carbon dioxide, combustion exhaust gases and the like, to a level below that at which spontaneous combustion occurs but not below that which will support combustion in the presence of an ignition source. After linkage has been completed, the oxygen content is increased to those levels required for efficient gasification. The degree of oxygen content reduction required may be determined by laboratory testing of core samples.

Having now fully described the invention, it will be apparent to one of ordinary skill in the art that many changes and modifications can be made thereto without departing from the spirit or scope thereof.

What is claimed:

1. A process to establish a stable gasification zone over the full seam thickness in the in situ gasification of coal which comprises:

establishing pneumatic communication between an injection well and a producing well;

igniting the coal seam at the injection well;

introducing gaseous oxidant at the injection well at a rate which is a minor fraction of the calculated maximum injection rate for a period of time sufficient to allow a gasification zone to expand outward from the bottom of the injection wellbore, downward to the bottom of the coal seam and upward around the wellbore to the top of the coal seam, and thereafter progressively increasing the injection rate until the calculated maximum rate has been attained.

2. The process of claim 1 wherein said injection well is cased at least two thirds of the way through the coal seam or to within about 5 feet of the seam bottom, whichever is closer to the bottom of the seam.

3. The process of claim 2 wherein the initial rate of oxidant introduction does not exceed about one third of the calculated maximum injection rate.

4. The process of claim 3 wherein the initial limited oxidant introduction rate is maintained during approximately the first 15% of the calculated well pair life and is thereafter progressively increased to the calculated maximum injection rate and maintained substantially at said rate for the remainder of the calculated well pair life.

5. The process of claim 4 wherein the injection rate is progressively increased to the calculated maximum injection rate over a period of time ranging from about 15% to 30% of the calculated well pair life.

6. The process of claim 2 wherein pneumatic communication is established between the injection well and producing well by reverse combustion linkage.

7. The process of claim 6 wherein the coal seam is pyrophoric to air and wherein the oxygen content of gas injected during reverse combustion linkage is reduced to a level below that at which spontaneous combustion occurs but above that which will support combustion in the presence of an ignition source.

8. The process of claim 7 wherein the gas injected during reverse combustion linkage is air diluted with a non-combustible gas.

9. The process of claim 2 wherein the path established for pneumatic communication between the injection and producing wells is randomly located within the vertical extent of the coal seam.

10. The process of claim 2 wherein said gaseous oxidant is air.

11. A method for conducting the in situ gasification of a coal seam which comprises:

establishing at least one process module, said module comprising an array of wells laid out in columns and rows in a generally rectangular pattern, said wells completed into the coal seam;

igniting the coal seam along a first row of wells making up a boundary of the process module at the bottom of at least alternate wells in said row;

establishing a stable gasification zone over the full seam thickness adjacent each well at which the coal seam was ignited, said stable gasification zone established by introducing a gaseous oxidant into each said well at a rate limited to a minor fraction of the calculated maximum injection rate for a period of time sufficient to allow a gasification zone to form and expand outwardly from the bottom of each said wellbore, downward to the bottom of the coal seam and upward to the top of said seam, and establishing pneumatic linkage between wells in the second row of said well array with adjacent wells in said first row.

12. The method of claim 11 wherein said wells are cased at least two thirds of the way through the coal seam or to within about 5 feet of the seam bottom, whichever is closer to the bottom of the seam.

13. The method of claim 12 wherein the initial rate of oxidant introduction is limited to one third or less of the calculated maximum injection rate during approximately the first 15% of the calculated well pair life.

14. The method of claim 13 wherein the spacing of wells between adjacent columns in said well array is approximately equal to, or less than, the spacing of wells between adjacent rows in said array.

15. The method of claim 13 including the steps of establishing pneumatic linkage between wells in said first row of said array, terminating oxidant injection into the wells in the first row and converting said first row wells from an oxidant injection mode to a production mode, introducing gaseous oxidant into the wells in the second row of said array at a rate less than about one third of the calculated maximum injection rate for approximately the first 15% of the calculated well pair life, and increasing the oxidant injection rate is said second row wells to the calculated maximum injection rate over a period of less than about 25% of the calculated well pair life.

16. The method of claim 15 including the further steps of establishing pneumatic linkage between wells in the third row of said well array with adjacent wells in said second row and, upon essential completion of gasification from said second row to said first row, terminating oxidant injection into the wells in said second row and converting said second row wells to producing wells, introducing gaseous oxidant into said third row wells at a rate less than about one third of the calculated maximum injection rate for approximately the first 15% of the calculated well pair life, shutting in said first row wells, increasing the oxidant injection rate in said third row wells to the calculated maximum injection rate over a period of less than about 25% of the well pair life and repeating said steps well row by well row to the extent of the process module.

17. The method of claim 16 wherein pneumatic linkage is established by means of reverse combustion.

18. The method of claim 16 wherein said oxidant gas is air.

19. The method of claim 16 wherein said coal seam contains essentially no free water and wherein carbon dioxide is injected in admixture with said oxidant gas.

20. The method of claim 16 wherein the shut in wells of said module are later produced to yield a hydrogen-rich gas.

21. The method of claim 13 including the sequential steps of arranging the wells in said second row as producing wells and increasing the rate of oxidant introduction into the wells of said first row to the maximum calculated injection rate.

22. The method of claim 21 including the further steps of establishing pneumatic linkage between wells in the third row of said array with adjacent wells in said second row, arranging said third row wells as production wells and, upon completion of gasification between said first and second well rows, converting said second row wells from producing wells to gaseous oxidant introduction wells and repeating said steps well row by well row to the extent of the process module.

23. The method of claim 22 wherein pneumatic linkage is established by means of reverse combustion.

24. The method of claim 22 wherein said oxidant gas is air.

25. The method of claim 22 wherein the coal seam contains essentially no free water and wherein carbon dioxide is injected in admixture with said oxidant gas.

26. The method of claim 22 wherein a hydrogen-rich gas is recovered from the process module after completion of gasification.

27. The method of claim 13 wherein the spacing of wells between adjacent columns in said well array is greater than the spacing between adjacent rows in said well array and wherein the coal seam is ignited at all wells in the first row of said array whereby essentially isolated gasification channels are formed along the columns of said array leaving ungasified coal between said channels to provide overburden support.

28. The method of claim 13 wherein the spacing of wells between adjacent columns in said array is increased as the probability of subsidence damage increases from a minimum spacing of less than that spacing between adjacent rows of said array to a maximum spacing of more than twice the spacing between adjacent rows.

29. In a method for the in situ gasification of a coal seam wherein said seam comprises an aquifer, the improvement comprising:

establishing at least one process module, the boundary of said module defined by a plurality of spaced wells completed to the coal seam;

establishing pneumatic communication between adjacent wells bounding said module;

igniting the coal seam at the bottom of at least one said well and establishing a stable gasification zone over the full seam thickness adjacent the bottom of said well:

progressively advancing said gasification zone from well to well around the periphery of said module to form a gasification channel in said coal seam defining the boundary of said module;

allowing said gasification channel to cool under the influence of influxing groundwater, and pumping water from said gasification channel until the module area has been sufficiently dewatered to allow efficient gasification of the coal seam.

30. The method of claim 29 in which said gasification zone is established over the full seam thickness by limiting the rate of oxidant introduction into said ignited wells to less than one third of the calculated maximum injection rate during approximately the first 15% of the calculated well pair life.

31. The method of claim 30 in which said wells are cased at least two thirds of the way through the coal seam or to within 5 feet of the seam bottom, whichever is closer to the bottom of the seam.

32. The method of claim 29 wherein the extent of dewatering within the module area is monitored by means of inspection wells.

* * * * *

UNITED STATES PATENT AND TRADEMARK OFFICE

CERTIFICATE OF CORRECTION

PATENT NO. : 4,306,621

DATED : December 22, 1981

INVENTOR(S) : R. Michael Boyd, et al

It is certified that error appears in the above—identified patent and that said Letters Patent is hereby corrected as shown below:

In Claim 28, line 6; after "of" insert --not--.

Signed and Sealed this

*Twenty-second* Day of *June 1982*

[SEAL]

*Attest:*

GERALD J. MOSSINGHOFF

*Attesting Officer*

*Commissioner of Patents and Trademarks*